US007108132B2

(12) United States Patent
Shih

(10) Patent No.: US 7,108,132 B2
(45) **Date of Patent: *Sep. 19, 2006**

(54) TOOL HOLDER WITH SPECIFICATION MARKING STRUCTURE

(76) Inventor: Leo Shih, No. 3 Jingcheng 7th St., Taichung (TW)

(*) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 10/717,947

(22) Filed: Nov. 19, 2003

(65) Prior Publication Data

US 2005/0103664 A1 May 19, 2005

(51) Int. Cl.
*B65D 85/20* (2006.01)
*A47F 7/00* (2006.01)

(52) U.S. Cl. ..... 206/378; 206/459.1; 211/70.6

(58) Field of Classification Search ..... 206/372–379, 206/459.1, 459.5, 557–565; 211/70.6; 40/5, 40/124.05, 124.06, 649
See application file for complete search history.

(56) References Cited

U.S. PATENT DOCUMENTS

| | | | | | |
|---|---|---|---|---|---|
| 506,103 | A * | 10/1893 | Dempsey | 206/561 |
| 1,560,009 | A * | 11/1925 | Wobber | 206/459.5 |
| 1,840,193 | A * | 1/1932 | Feldman et al. | 40/5 |
| 3,397,434 | A * | 8/1968 | Arblaster | 40/5 |
| 4,557,389 | A * | 12/1985 | Williams et al. | 211/70.6 |
| 4,621,738 | A * | 11/1986 | DeLucchi | 211/70.6 |
| 6,168,018 | B1 * | 1/2001 | Ramsey et al. | 206/378 |
| 6,488,151 | B1 * | 12/2002 | Ramsey et al. | 206/378 |

* cited by examiner

*Primary Examiner*—Bryon P. Gehman
(74) *Attorney, Agent, or Firm*—W. Wayne Liauh

(57) ABSTRACT

A tool holder comprises a holding portion and a specification marking member. The holding portion is used to secure a tool, whereas the specification marking member is used to mark thereon a specification corresponding to the specification of the tool. The specification marking member is formed of a retaining portion extending from the holding portion, and a marking portion on which a specification is marked. The marking portion is removably located in the retaining portion.

7 Claims, 10 Drawing Sheets

TOOL HOLDER WITH SPECIFICATION MARKING STRUCTURE

FIELD OF THE INVENTION

The present invention relates to a tool holder which is provided with a specification marking structure to facilitate the organizing and the retrieving of a plurality of tools.

BACKGROUND OF THE INVENTION

As shown in FIG. 1, a previous embodiment of the present invention, tool seat 1 is provided with a specification marking portion 2 on which a specification corresponding to that of a socket 3 is marked. In light of the specification marking portion 2 being a fixed structure, the tool seat 1 is limited in purpose. A socket wrench set may have sockets of up to thirty specifications in the English System, or thirty three specifications in the Metric System. In another words, the tool seat 1 in the prior embodiment is not interchangeable in terms of specification.

As shown in FIG. 2, tool holder base 10 comprises a plurality of seats 12 for holding a plurality of sockets 11 various in specification. The seats 12 are provided with a specification marking portion 14 and are located on the tool holder base 10 by a locating hole 13 of the base 10. The seats 12 are also defective in design in that they are limited in purpose, and that they are not interchangeable in terms of specification.

As shown in FIG. 3, a tool holder base 10 is provided with a plurality of seats for holding a plurality of tool component parts 11. The seats are not interchangeable in terms of specification.

SUMMARY OF THE INVENTION

The primary objective of the present invention is to provide a hand tool holder which is versatile in design and is therefore interchangeable in terms of specification.

The hand tool holder of the present invention comprises a plurality of seats for holding a plurality of tools or component parts of the tools. The seats are provided with a specification marking member which is formed of a retaining portion and a specification marking portion which is removably retained in the retaining portion. The retaining portion is provided in an upper side with a first locating portion, whereas the specification marking portion is provided in an underside with a second locating portion engageable with the first locating portion.

The features and the advantages of the present invention will be more readily understood upon a thoughtful deliberation of the following detailed description of the present invention with reference to the accompanying drawings.

DETAILED DESCRIPTION OF THE INVENTION

Figure 1:
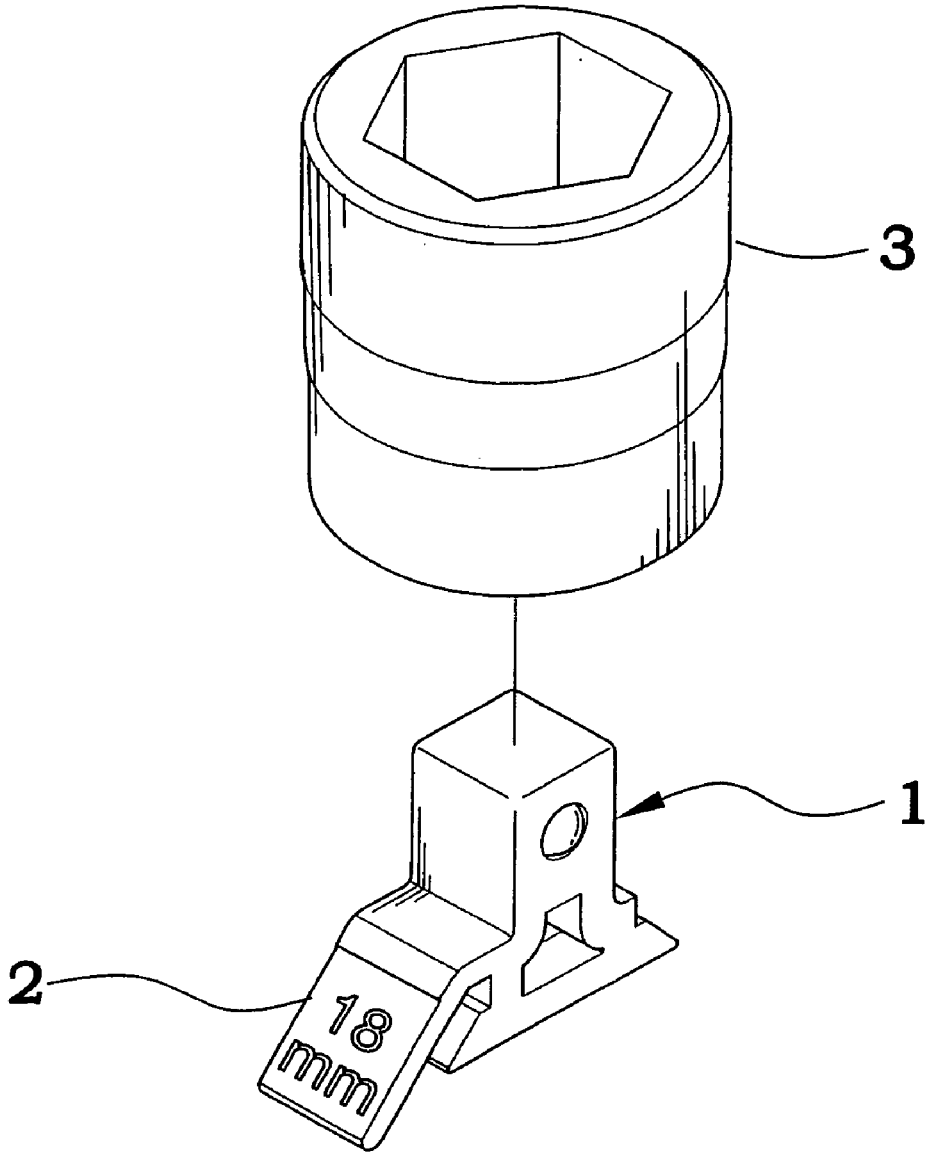
FIG. 1 shows a schematic view of a first prior art tool holder.
Figure 2:
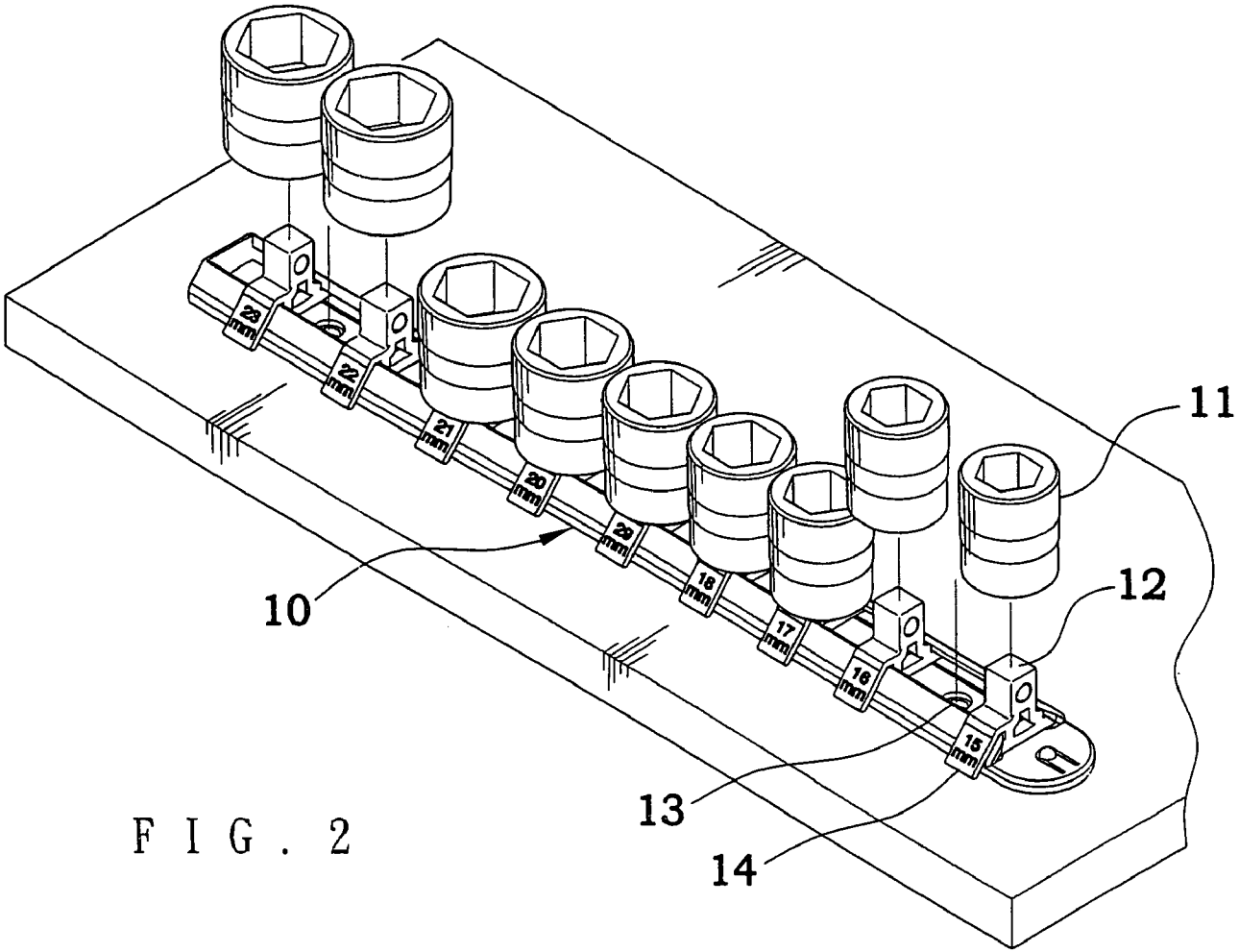
FIG. 2 shows a schematic view of a second prior art tool holder.
Figure 3:
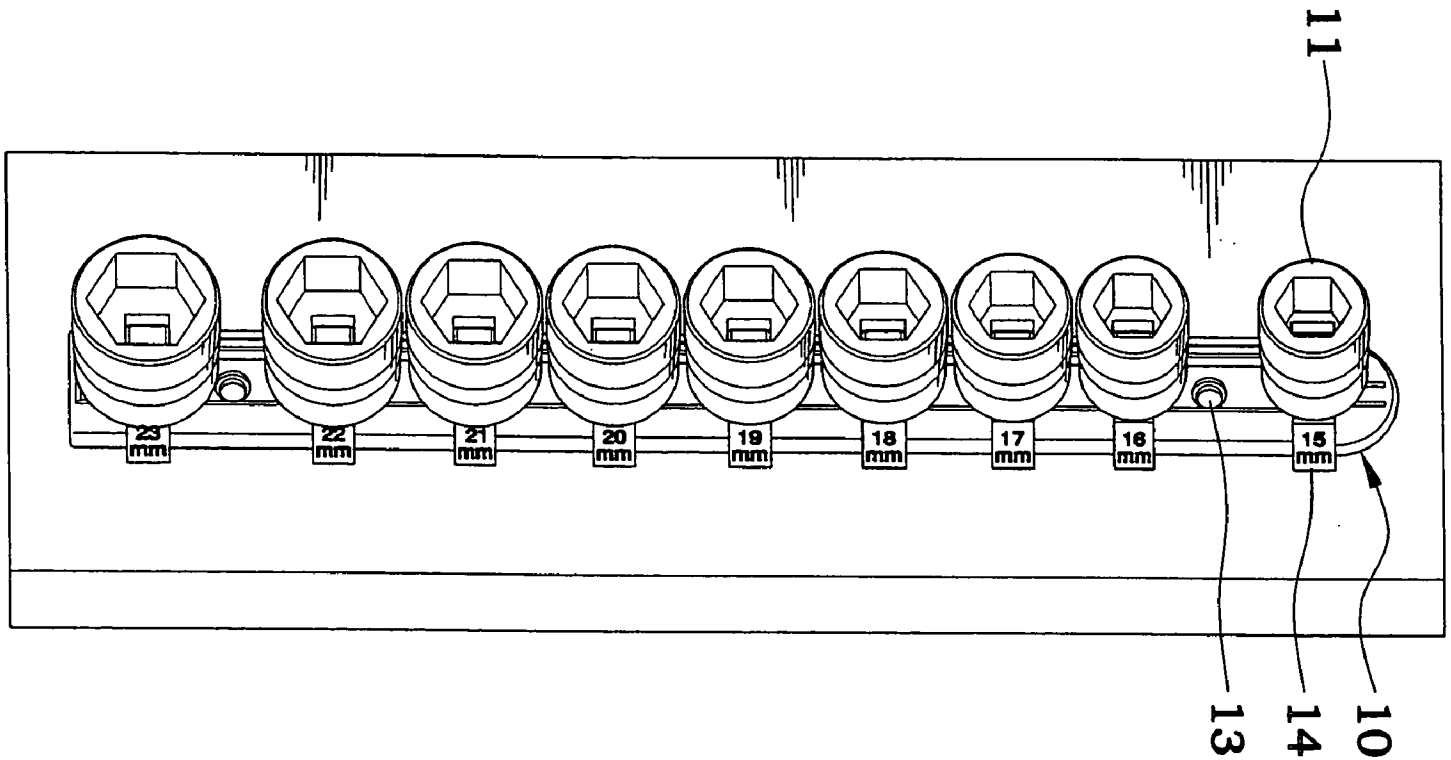
FIG. 3 shows a schematic view of a third prior art tool holder.
Figure 4:
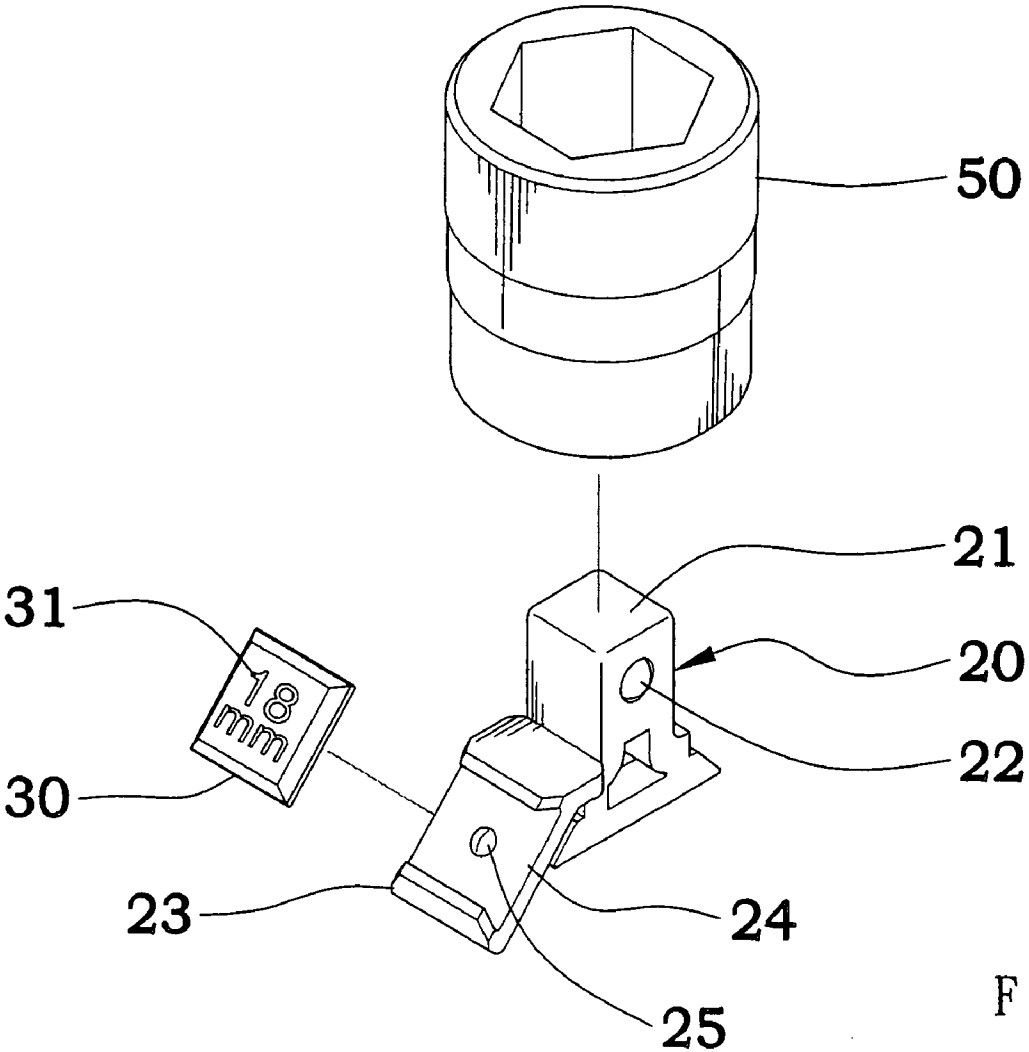
FIG. 4 shows an exploded view of the present invention.
Figure 5:
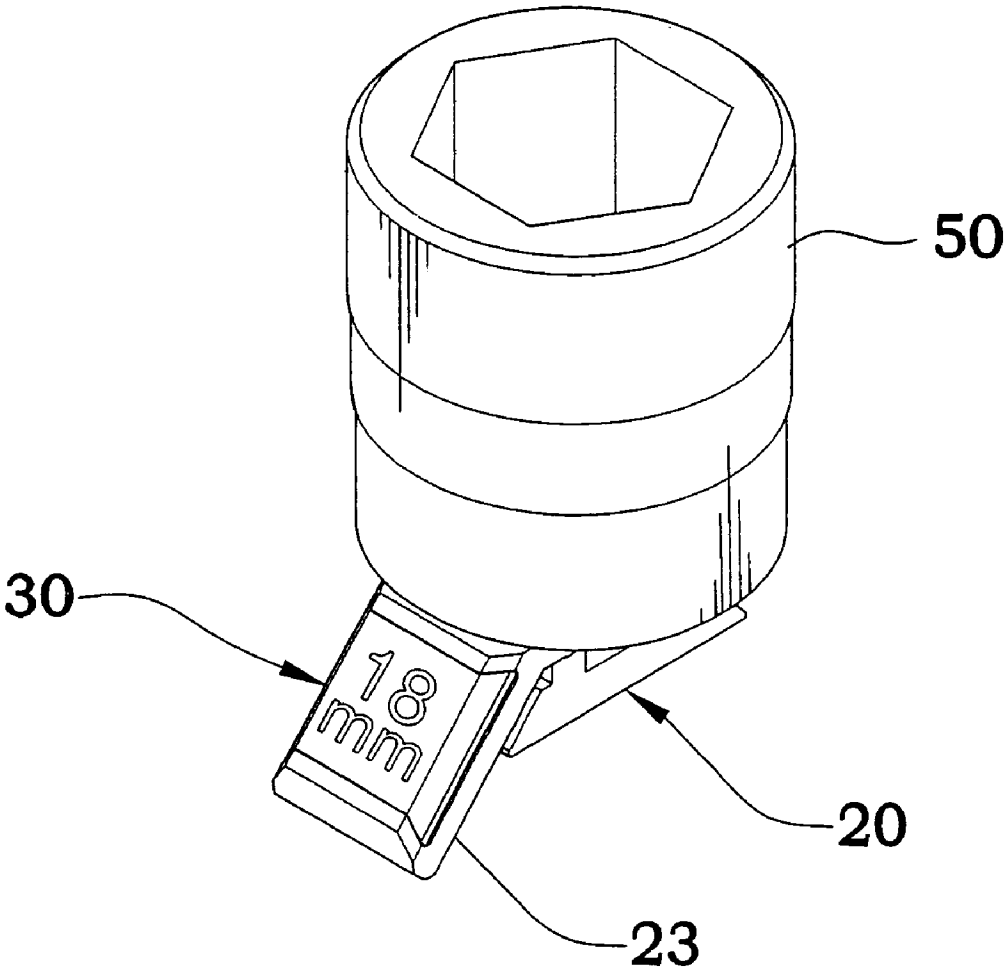
FIG. 5 shows a perspective view of the present invention in combination.
Figure 6:
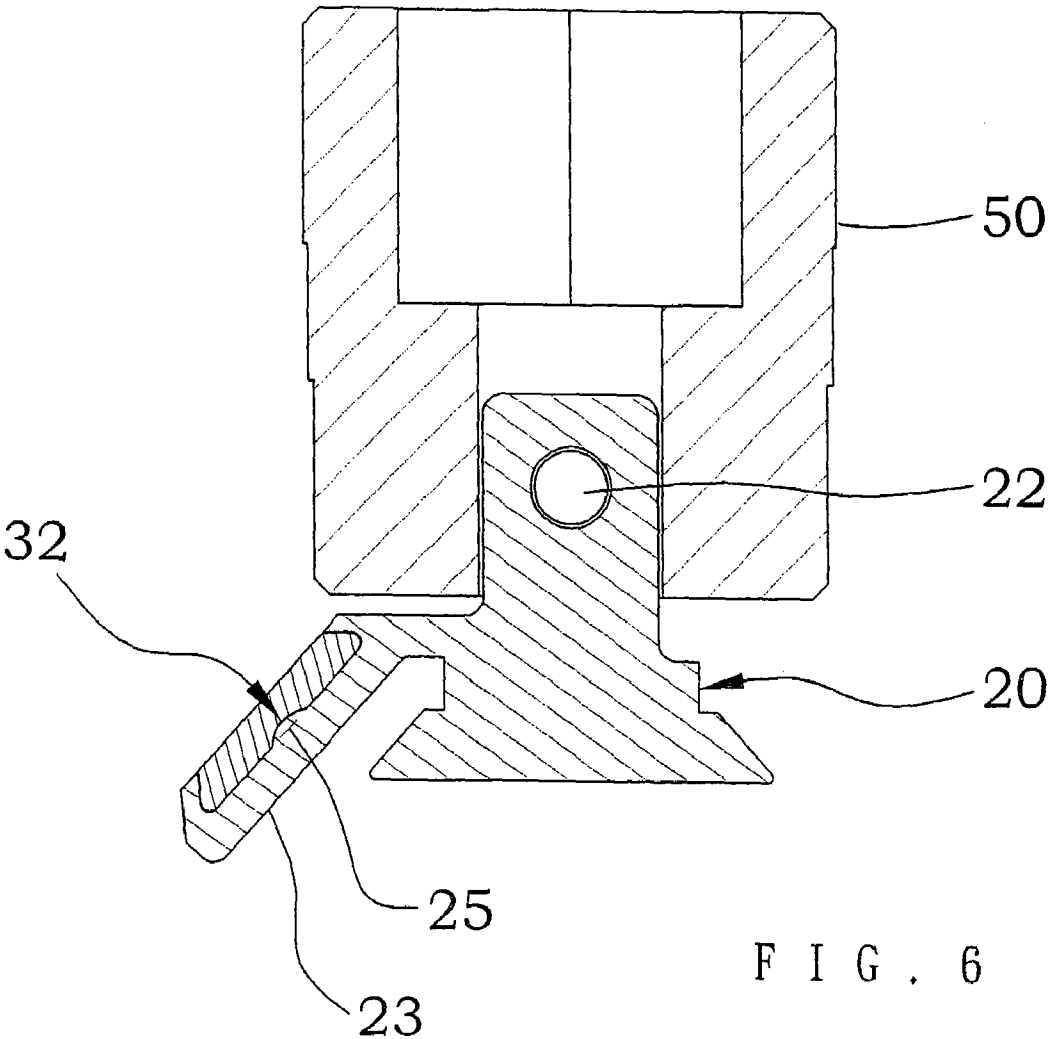
FIG. 6 shows a sectional schematic view of the present invention as shown in FIG. 5.

As shown in FIGS. 4–6, a tool holder 20 of the present invention is used to hold a socket 50 of the socket wrench. The tool holder 20 is formed of a holding portion 21 and a specification marking member 23. The holding portion 21 is provided with a retaining ball 22 for locating the socket 50 which is fitted over the holding portion 21. The subject matter of the present invention is the specification marking member 23 which is formed of a retaining portion 24 and a specification marking portion 30. The retaining portion 24 is fixed with the tool holder 20 and is provided in an upper side with a first locating element 25, which is a locating projection. The specification marking portion 30 is provided on an upper side with a specification mark, such as 18 mm, and in an underside with a second locating element 32, which is a locating groove corresponding to the locating projection 25 of the retaining portion 24. The specification marking portion 30 is removably received in the retaining portion 24 and is securely located in the retaining portion 24 by the locating projection 25 which is received in the locating groove 32 of the specification marking portion 30, as illustrated in FIG. 6.

Figure 7:
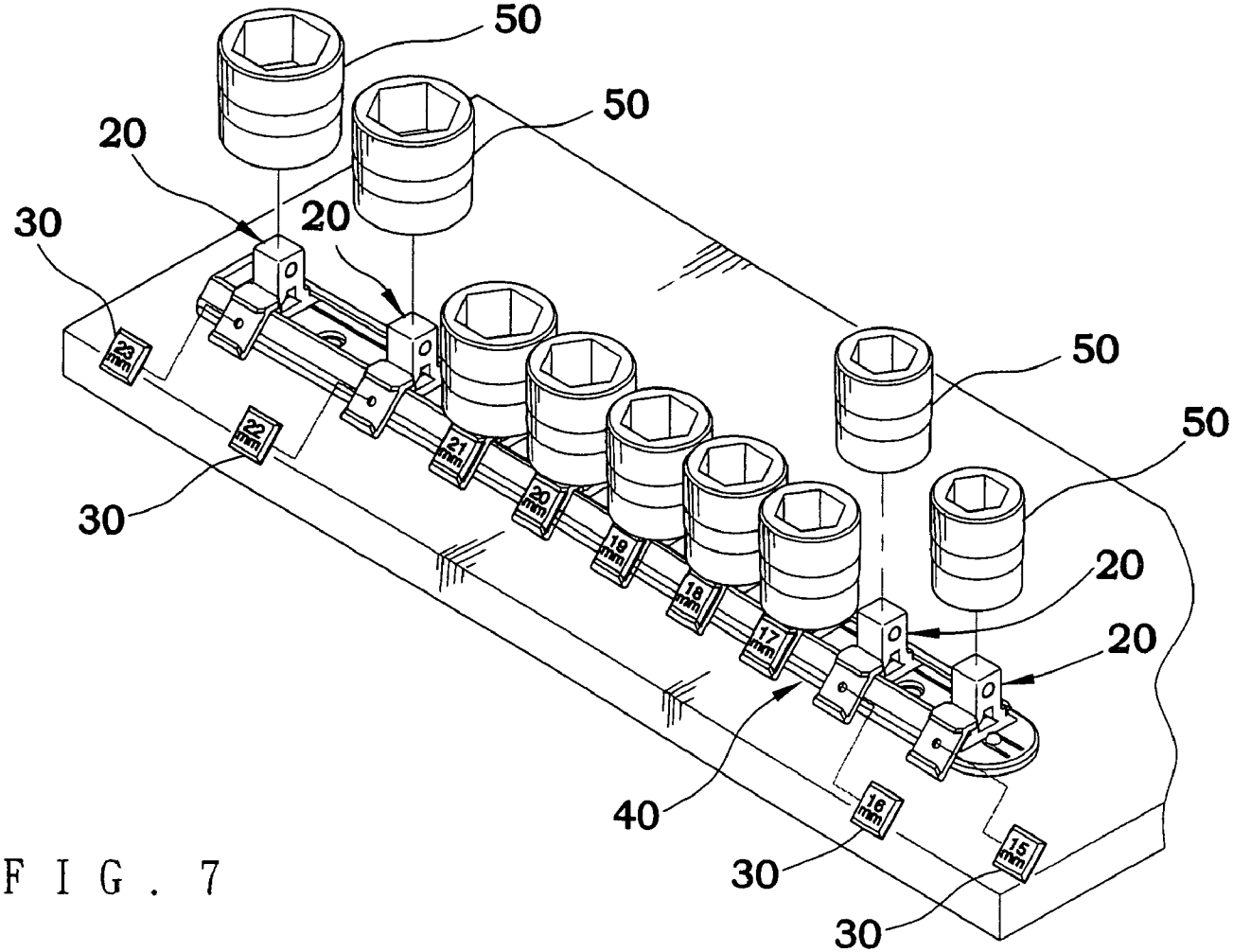
FIG. 7 shows a schematic view of a first embodiment of the present invention.

As illustrated in FIG. 7, the sockets 50 of various specifications are retained by a plurality of tool holders 20. The socket specifications are expressed in the Metric System. The specification marking portions 30 are marked with different specifications and can be interchangeably fitted into the retaining portion 24 of the specification marking member 23 of the tool holders 20.

Figure 8:
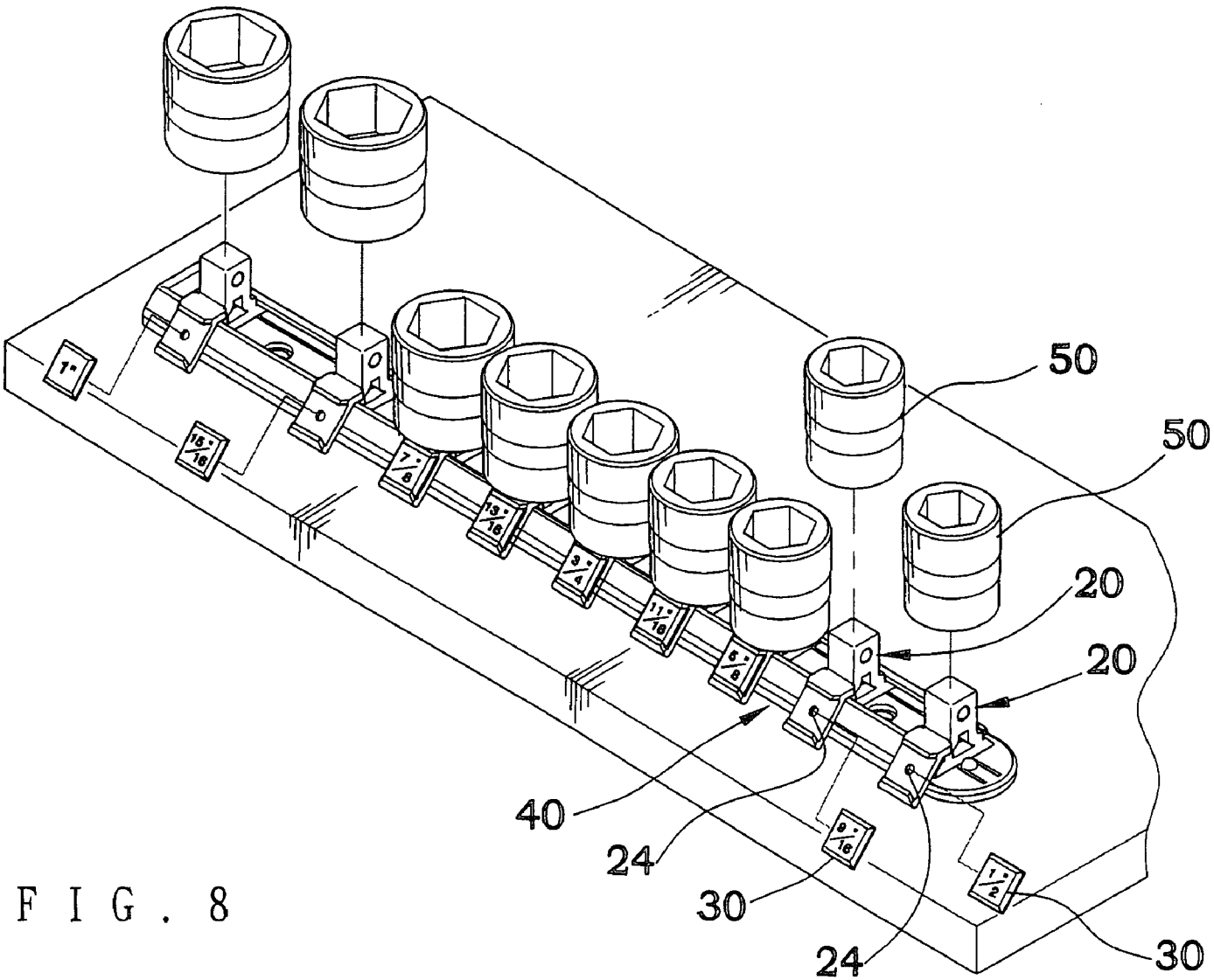
FIG. 8 shows a schematic view of a second embodiment of the present invention.

As illustrated in FIG. 8, the sockets 50 have different specifications, which are expressed in the English System. The present invention can be used interchangeably without regard to the Metric System or English System.

Figure 9:
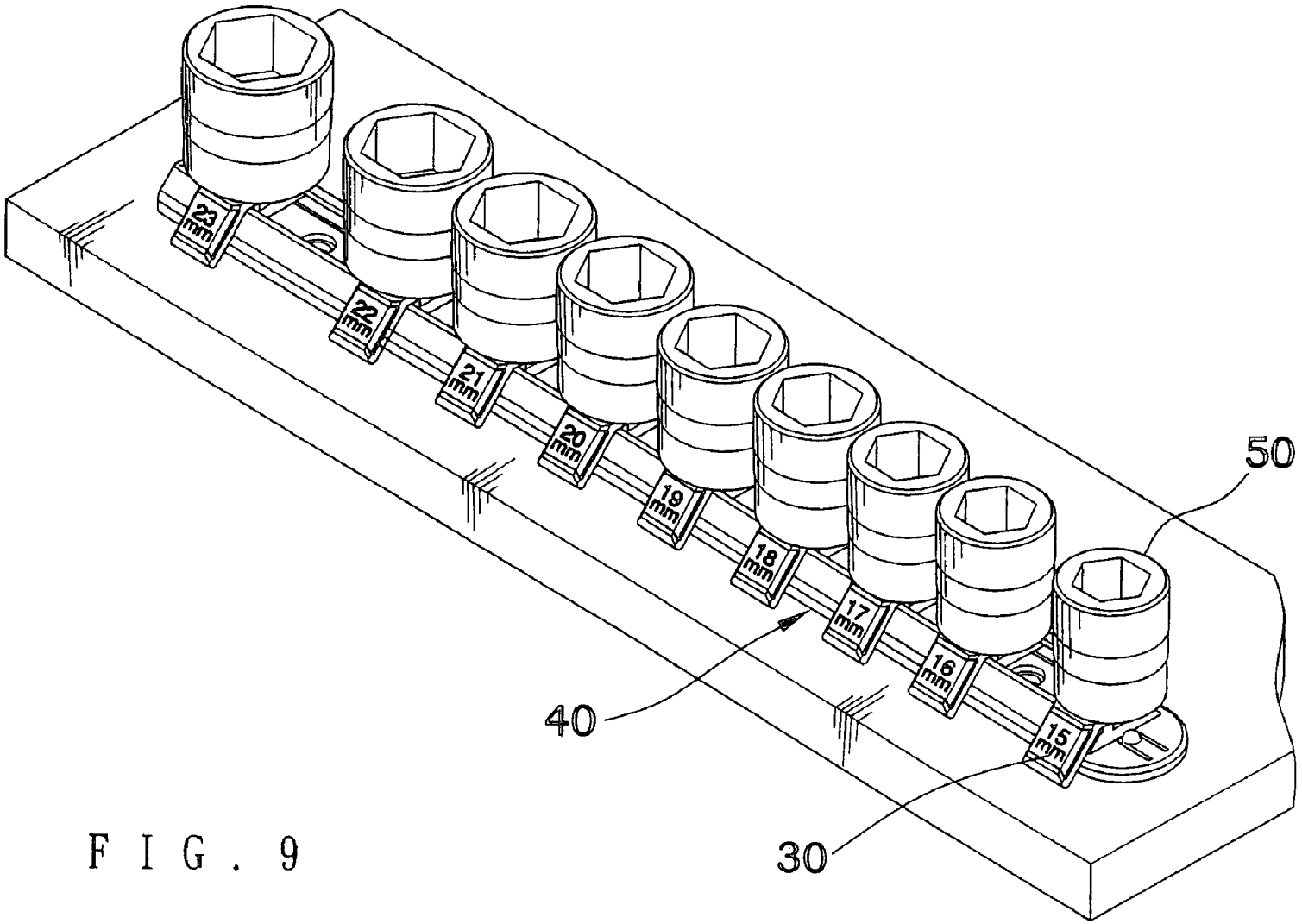
FIG. 9 shows a schematic view of a third embodiment of the present invention.
Figure 10:
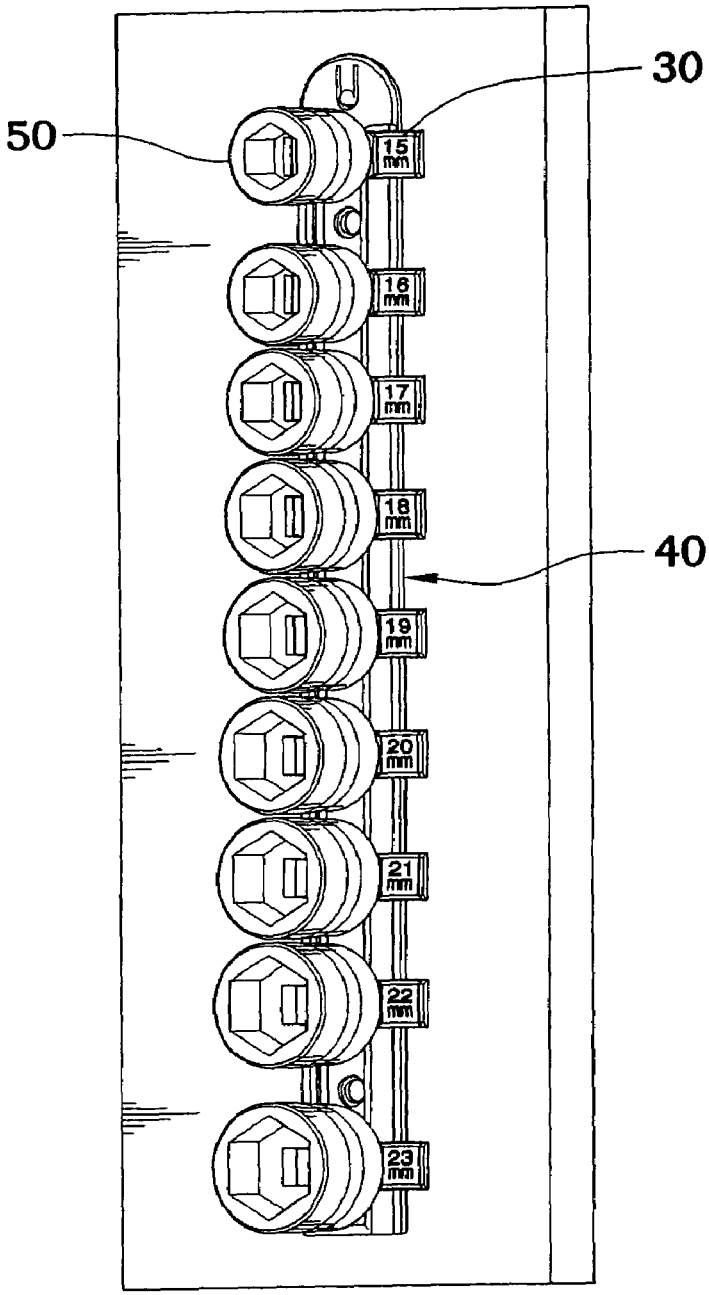
FIG. 10 shows a schematic view of a fourth embodiment of the present invention.

As a series of the sockets 50 are held by the tool holder of the present invention, the specification marking portions 30 are all arranged in the same side of the tool holder base 40, as illustrated in FIGS. 9 and 10, thereby enabling a user of the tool to spot a specific socket 50 with ease and speed.

The present invention described above is to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A tool holder for holding a plurality of tools, comprising:

a base;

a plurality of holding-and-mark-retaining members individually mounted on said base, each for holding and marking a tool with a specification; and a plurality of specification marking members, each for marking the specification of a tool;

wherein each of said holding-and-mark-retaining members comprising:

a holding portion for holding a tool;

a mark-retaining portion for retaining a said specification marking; member and a retaining means for removably retaining a said specification marking member in said mark-retaining portion;

further wherein said holding-and-mark-retaining members are movable relative to each other.

2. The tool holder as defined in claim 1, wherein said retaining means in each of said holding-and-mark-retaining members comprises a first locating element provided in an upper face of its corresponding said mark-retaining portion and a second locating element provided in an under face of its corresponding said specification marking member.

3. The tool holder as defined in claim 2, wherein said first locating element is in the form of a protrusion, and said second locating element is in the form of a receiving groove.

4. The tool holder as defined in claim 2, wherein said second locating element is in the form of a protrusion and said first locating element is in the form of a receiving groove.

5. The tool holder as defined in claim 1, wherein each said retaining means contains a sliding means such that a said specification marking member is slidably received in its corresponding said mark-retaining portion.

6. The tool holder as defined in claim 1, wherein each said mark-retaining portion is constructed in the form of a channel so as to allow a said specification marking member to be slidably received in said mark-retaining portion.

7. The tool holder as defined in claim 1, wherein said holding-and-mark-retaining members are slidably mounted on said base.

* * * * *